United States Patent [19]

White

[11] Patent Number: 4,911,677

[45] Date of Patent: Mar. 27, 1990

[54] NURSING BRA

[76] Inventor: Barbara E. White, 208 States St., Apt. #2, San Francisco, Calif. 94114

[21] Appl. No.: 303,567

[22] Filed: Jan. 27, 1989

[51] Int. Cl.[4] ..... A41C 3/04

[52] U.S. Cl. ..... 450/36; 2/104; 450/58; 450/59; 450/79

[58] Field of Search ..... 2/104; 450/36, 50, 58, 450/59, 79, 18

[56] References Cited

U.S. PATENT DOCUMENTS

| | | | |
|---|---|---|---|
| 2,454,153 | 11/1948 | Glick | 450/36 |
| 2,706,816 | 4/1955 | Dozier | 450/36 |
| 3,203,424 | 8/1965 | Garutso | 450/36 X |
| 3,256,886 | 6/1966 | Sachs | 450/59 |
| 3,338,241 | 8/1967 | Cousins | 450/36 |
| 3,507,285 | 4/1970 | Williams | 450/36 X |
| 4,530,361 | 7/1985 | Wooten | 450/59 |

FOREIGN PATENT DOCUMENTS

| | | | |
|---|---|---|---|
| 1026555 | 4/1953 | France | 450/58 |
| 1030273 | 6/1953 | France | 450/58 |
| 0407417 | 10/1946 | Italy | 450/58 |

OTHER PUBLICATIONS

Maurice Gershman, "Self Adhering Nylon Tapes", *The J.A.M.A.,* vol. 168, No. 7, p. 930, Date: Oct. 1958.

*Primary Examiner*—Werner H. Schroeder
*Assistant Examiner*—Jeanette E. Chapman
*Attorney, Agent, or Firm*—Owen, Wickersham & Erickson

[57] ABSTRACT

A nursing brassiere is disclosed having a frontal section comprised of partially overlapping frontal portions each adapted to cover one side of a wearer's chest area. The frontal portions are connected to a lower band that fits around the wearer and has inner and outer overlapping members which are normally held together but are separable. Each frontal portion is attached to one overlapping band member so that it can be separately displaced by the wearer to facilitate nursing.

4 Claims, 1 Drawing Sheet

NURSING BRA

This invention relates to wear apparel for women, and more particularly to a nursing brassiere for a mother.

BACKGROUND OF THE INVENTION

Various forms of upper body garments for women who must periodically nurse their child have been devised. Many such garment designs have utilized fasteners of some sort to temporarily release a portion of the garment and thereby provide the baby access to its mother's breast. The use of such fasteners has obvious disadvantages, one of which is the difficulty in maneuvering and adjusting the bra garment before nursing can commence. Thus, the need arose for a nursing garment that does not require conventional fasteners such as snaps or buttons and yet one that can be quickly manipulated to provide access to either breast to facilitate nursing. The present invention solves this problem.

A more specific object of the invention is to provide a nursing bra wherein either of two flexible frontal portions can be merely pulled upwardly when the wearer wishes to commence nursing and can be replaced to the normal position after nursing with only slight finger pressure.

Another object of the invention is to provide a nursing bra that has an attractive appearance, provides ample support for the wearer and is also durable and easy to launder.

Still another object of the invention is to provide a nursing bra that is particularly well adapted for ease and economy of manufacture.

SUMMARY OF THE INVENTION

In accordance with the principles of the invention a nursing bra is provided which comprises a frontal member having two roughly triangular shaped cup-like portions having a relatively narrow upper en portion and a relatively wide lower end portion. These two triangular shaped portions are adapted to cover the wearer's breasts and they overlap approximately at the midpoint of the wearer's chest. The relatively narrow upper end of each triangular shaped portion forms a shoulder strap adapted to extend over the wearer's shoulder. These shoulder straps extending from the two frontal members connect with a back member. The relatively wide lower ends of the two triangular shaped portions are connected to a pair of separate but overlapping band members of elastomeric material located around the front of the garment. Around the rear of the garment the back member is secured to a single band member. The two overlapping frontal band members are normally connected together in the front of the garment by a plurality of spaced apart pressure activated elements located on the adjacent bands at preselected locations. Thus, when the bra is worn for normal use, the pressure sensitive fasteners hold the overlapping band member together as if they were a unitary band. Yet, when the wearer wishes to nurse her baby, a small amount of tension will quickly separate the frontal bands and facilitate upward displacement of one frontal portion.

Other objects, advantages and features of the invention will become apparent from the following detailed description of one embodiment thereof, presented in conjunction with the accompanying drawing.

DETAILED DESCRIPTION OF EMBODIMENT

Figure 1:
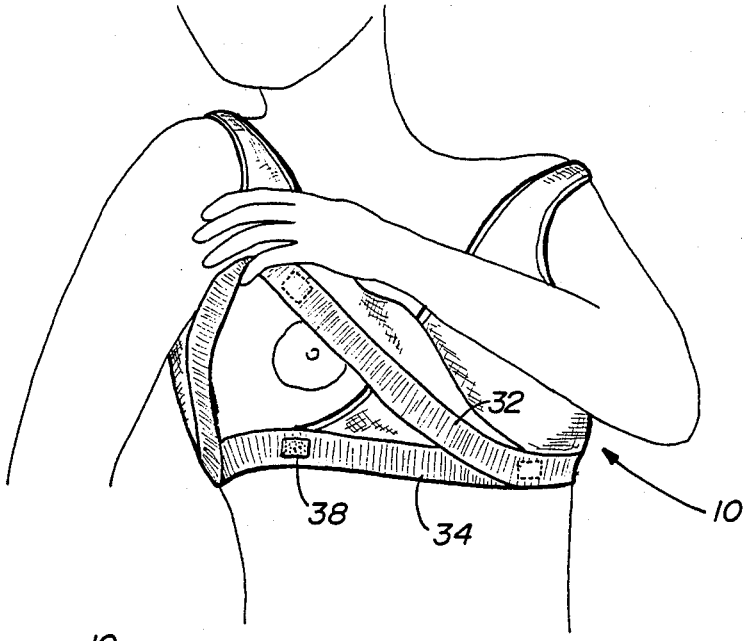
FIG. 1 is a view in perspective showing a nursing bra embodying principles of the present invention as it appears when being adjusted for use.

With reference to the drawing, FIG. 1 shows a nursing bra 10 as it appears when being worn and as it is manipulated to provide access to the wearer's breast to facilitate nursing. As shown, a simple movement with one hand enables a portion of the bra to be displaced from its normal breast covering position.

Figure 2:
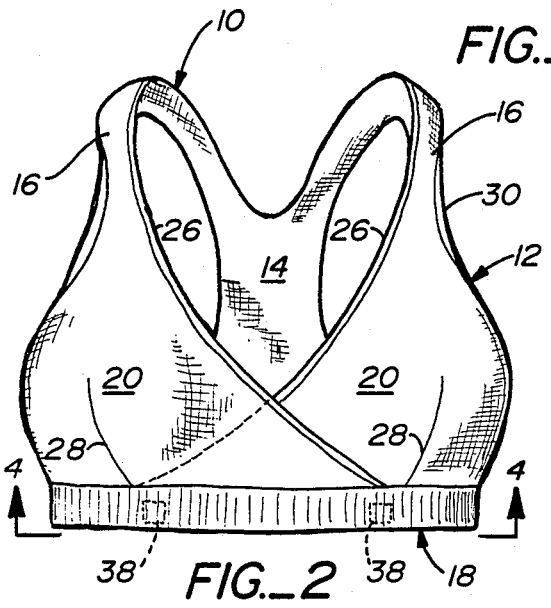
FIG. 2 is a front view in elevation of the bra in FIG. 1.

Turning to FIG. 2, it is seen that the bra 10 may be cut from a simple piece of suitable cloth material to provide a frontal section 12, and a back section 14 connected by shoulder straps 16 and a bottom or waist band 18.

The frontal section 12 is comprised of two generally triangular cup portions 20, each having a relatively wide lower end area 24 defined by a sloping edge 26. These two triangular portions 20 overlap each other near their lower ends, and their sloping edges 26 cross over each other at a point approximately along the longitudinal centerline of the wearer's chest.

Figure 3:
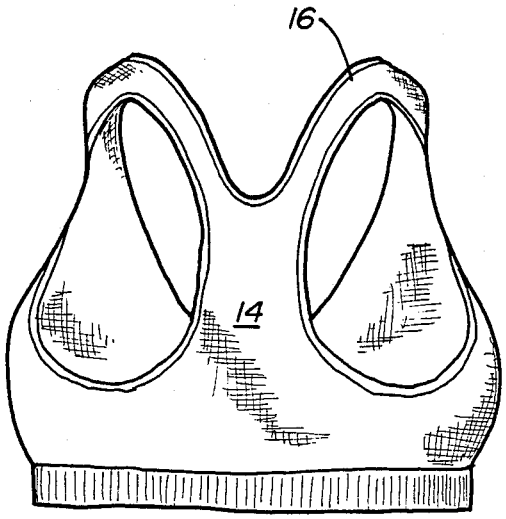
FIG. 3 is a rear view in elevation of the bra in FIG. 1.
Figure 5:
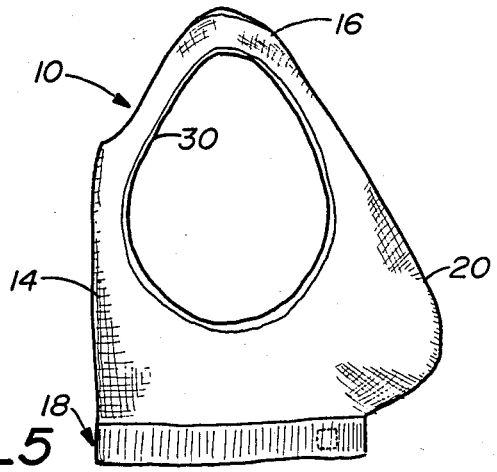
FIG. 5 is a side view in elevation of the bra in FIG. 1.

The frontal cup portions 20 can be shaped and provided with "darts" 28 or other known sewing designs and they may have an inner lining material (not shown) if desired to vary the fullness and fit of the bra for various wearer sizes, as indicated in FIGS. 2 and 5. The edges 26 and other edges 30 forming the arm holes for the shoulder straps and the back section are preferably provided with a suitable material reinforcement in the well known manner. As shown in FIG. 3, the back section 14 may be relatively narrow compared with the area of the frontal section 12. If desired, the back section 14 can be eliminated altogether, so that the shoulder straps 16 are connected directly to a back portion of the waist band 18.

Figure 4:
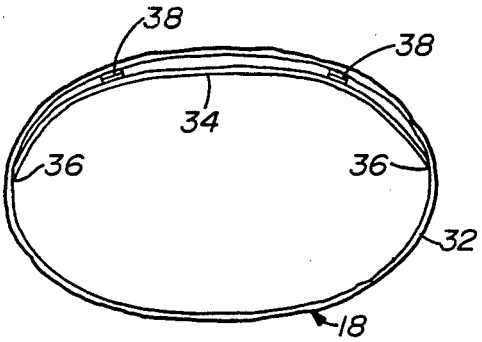
FIG. 4 is a bottom view taken along the line 4—4 of FIG. 2.

As shown in FIG. 4, the waist band 18 is comprised of two band members 32 and 34 which overlap each other at the front side of the garment 10. The outer band member 32 is continuous and therefore extends completely around the wearer. The inner band member 34, preferably of the same width, fits inside and is adjacent to the outer band member around the front side of the bra 10. The ends 36 of the inner band are fixed to the outer band, as by stitching, at locations near the opposite sides of the garment. As shown in FIG. 2, one frontal portion 20 of the bra is stitched to the outer band member 32 and the other overlapping frontal portion is stitched to the inner band member 34. At two spaced apart locations on the front side of the garment, the two band members 32 and 34 are temporarily held in place by a pair of adhesive patches 38 of pressure sensitive material. Such material generally comprises a pair of complementary elements having the same shape and area, one element having of hook-like members and one having a porous or fibrous material, which members adhere when pressed together. Such material is sold commercially under the Trademark VELCRO.

Thus, when worn, the band members 32 and 34 are held together by the adhering patches 38 and hold the bra frontal portions 20 in their normal overlapping, covering and supporting position. When the wearer desires to displace one frontal portion, only a small amount of tension is required to pull it upwardly, as shown in FIG. 1. All manipulation of the bra can be accomplished with one hand, quickly and easily.

The preferred embodiment described herein is intended to be purely illustrative, and not limiting of the scope of the invention. Other embodiments and variations will be apparent to those skilled in the art and may be made without departing from the essence and scope of the invention as defined in the following claims.

What is claimed is:

1. A nursing brassiere adapted to be worn on the upper body of a woman to provide support during normal wear periods and easy access to either breast during nursing periods, said brassiere comprising:

a frontal section having partially overlapping frontal portions each adapted to cover one side of a wearer's chest area, each frontal portion having a relatively narrow upper end and a relatively wide lower end;

band means at the lower edge of said frontal section comprising a pair of overlapping inner and outer band members, each connected to said lower ends of one said frontal portion, said outer band member being continuous and extending completely around the wearer, and said inner band member being shorter than and attached at its ends to said outer band member.

shoulder strap means interconnecting said upper ends of said frontal portions with a rear portion of said band means and thereby forming arm holes; and releasable means for holding said inner and outer band members together but separable when one of said frontal portions is required to be displaced to facilitate nursing.

2. The nursing brassiere as described in claim 1 wherein said releasable means for holding said inner and outer band members together comprise a pair of spaced apart pairs of pressure sensitive adhering elements.

3. The nursing brassiere as described in claim 1 wherein each said frontal portion of said frontal section is a generally triangular cup-like piece of flexible material.

4. The nursing brassiere as described in claim 1 wherein said shoulder strap means merge together to form a back section which is fixed to said rear portion of said band means.

* * * * *